US010109402B2

(12) United States Patent
Kato et al.

(10) Patent No.: US 10,109,402 B2
(45) Date of Patent: Oct. 23, 2018

(54) RARE EARTH BASED MAGNET

(71) Applicant: TDK CORPORATION, Tokyo (JP)

(72) Inventors: Eiji Kato, Tokyo (JP); Yoshinori Fujikawa, Tokyo (JP); Taeko Tsubokura, Tokyo (JP); Chikara Ishizaka, Tokyo (JP); Katsuo Sato, Ichikawa (JP)

(73) Assignee: TDK CORPORATION, Tokyo (JP)

( * ) Notice: Subject to any disclaimer, the term of this patent is extended or adjusted under 35 U.S.C. 154(b) by 516 days.

(21) Appl. No.: 14/332,808

(22) Filed: Jul. 16, 2014

(65) Prior Publication Data

US 2015/0270041 A1 Sep. 24, 2015

(30) Foreign Application Priority Data

Jul. 16, 2013 (JP) ..... 2013-147691
Dec. 20, 2013 (JP) ..... 2013-263373

(51) Int. Cl.
*H01F 1/057* (2006.01)
*H01F 1/055* (2006.01)
(Continued)

(52) U.S. Cl.
CPC ..... *H01F 1/0577* (2013.01); *C22C 38/002* (2013.01); *C22C 38/005* (2013.01);
(Continued)

(58) Field of Classification Search
None
See application file for complete search history.

(56) References Cited

U.S. PATENT DOCUMENTS 4,814,139 A * 3/1989 Tokunaga ..... H01F 1/0577 148/104
5,472,525 A * 12/1995 Tokunaga ..... H01F 1/057 148/302
(Continued)

FOREIGN PATENT DOCUMENTS

CN 104078176 A 10/2014
JP A-59-222564 12/1984
(Continued)

OTHER PUBLICATIONS

Ni et al. (Journal of Magnetism and Magnetic Materials, 2011, vol. 323, p. 2549-2553).*

*Primary Examiner* — Xiaowei Su
(74) *Attorney, Agent, or Firm* — Oliff PLC

(57) ABSTRACT

The present invention provides a rare earth based magnet that inhibits the high temperature demagnetization rate even when less or no heavy rare earth elements such as Dy, Tb and the like than before are used. The rare earth based magnet according to the present invention is a sintered magnet which includes $R_2T_{14}B$ crystal grains as main phase and grain boundary phases between the $R_2T_{14}B$ crystal grains. When the grain boundary phase surrounded by three or more main phase crystal grains is regarded as the grain boundary multi-point, the microstructure of the sintered body is controlled so that the ratio of the grain boundary triple-point surrounded by three main phase crystal grains in all grain boundary multi-points to be specified value or less.

2 Claims, 3 Drawing Sheets

(51) Int. Cl.

| | |
|---|---|
| ***C22C 38/00*** | (2006.01) |
| ***C22C 38/02*** | (2006.01) |
| ***C22C 38/06*** | (2006.01) |
| ***C22C 38/16*** | (2006.01) |

(52) U.S. Cl.
CPC ..... *C22C 38/008* (2013.01); *C22C 38/02* (2013.01); *C22C 38/06* (2013.01); *C22C 38/16* (2013.01); *H01F 1/0557* (2013.01)

(56) References Cited

U.S. PATENT DOCUMENTS

| | | | | |
|---|---|---|---|---|
| 2010/0233016 | A1 | 9/2010 | Tsubokura et al. | |
| 2014/0132377 | A1* | 5/2014 | Nakajima | B22F 3/24 335/302 |
| 2014/0290803 | A1 | 10/2014 | Kato et al. | |
| 2016/0042847 | A1* | 2/2016 | Nishiuchi | C22C 38/001 335/302 |

FOREIGN PATENT DOCUMENTS

| | | | |
|---|---|---|---|
| JP | B2-7-78269 | 8/1995 | |
| JP | A-2002-327255 | 11/2002 | |
| JP | WO 2013008756 A1 * | 1/2013 | B22F 3/24 |
| JP | 2013-070062 A | 4/2013 | |

* cited by examiner

RARE EARTH BASED MAGNET

The present invention relates to a rare earth based magnet, especially a rare earth based magnet obtained by controlling the microstructure of the R-T-B based sintered magnet.

BACKGROUND

The R-T-B based sintered magnet (R represents a rare earth element, T represents one or more elements of iron group elements containing Fe as an essential, and B represents boron), a representative of which is Nd—Fe—B based sintered magnet, is advantageous for miniaturization and high efficiency of the machines using it due to high saturation flux density, and thus can be used in the voice coil motor of the hard disk drive and the like. In recent years, the R-T-B based sintered magnet also has been applicable in various industrial motors, or driving motors of hybrid vehicles, or the like. From the viewpoint of energy conservation and the like, it is desirable that the R-T-B based sintered magnet can be further popularized in these fields. However, when applied in the hybrid vehicles and the like, the R-T-B based sintered magnet will be exposed to a relatively high temperature. Therefore, inhibition of the high temperature demagnetization caused by heat becomes important. For inhibition of the demagnetization under high temperature, a method for sufficiently improving coercivity of the R-T-B based sintered magnet at room temperature is well known as effective. In addition, the iron group elements in the present specification mean Fe, Co and Ni.

For example, as a method for improving a coercivity of the Nd—Fe—B based sintered magnet at room temperature, a method in which part of Nd of the compound $Nd_2Fe_{14}B$ as the main phase is replaced with heavy rare earth elements such as Dy, Tb and the like is well known. By replacing part of Nd with the heavy rare earth elements, the magnetic anisotropy of crystals is increased, and as a result, the coercivity of the Nd—Fe—B based sintered magnet at room temperature can be sufficiently improved. In addition to the replacement with heavy rare earth elements, addition of elements such as Cu and the like is also effective in improving coercivity at room temperature (Patent Document 1). By adding the element Cu, the phase such as Nd—Cu liquid phase can be formed by the element Cu at the grain boundary, and thus it is considered that the grain boundary become smooth and formation of reverse magnetic domains is inhibited.

However, in the R-T-B based rare earth based magnet, the ideal existing form of the $R_2T_{14}B$ as the main phase was pointed out at the initial stage of development. In Patent Document 2, it is described that 'as the existing form of the tetragonal compound, it is ideal that the fine particles having high anisotropy constant are isolated by the non-magnetic phase'.

Patent Documents

Patent Document 1: JP2002-327255A
Patent Document 2: JPH07-78269B

SUMMARY

In the case of using the R-T-B based sintered magnet at a high temperature of 100° C.~200° C., although the value of coercivity at room temperature is one of the effective indicators, no demagnetization or little demagnetization rate even when practically exposed to a high temperature environment is very important. Although coercivity of the composition in which part of R of the compound $R_2T_{14}B$ as the main phase is replaced by the heavy rare earth elements such as Tb or Dy is sharply improved at room temperature and this is a simple method for being a high coercivity, there are problems in terms of the resources since the heavy rare earth elements such as Dy, Tb and the like are limited in producing areas and yields. Accompanied with replacement, it is unavoidable for e.g., decrease of residual flux density due to antiferromagnetic coupling of Nd and Dy. Addition of the element Cu as described above and the like are also effective. Nonetheless, in order to enlarge the applicable field of the R-T-B based sintered magnet, it is desirable that the inhibition on the high temperature demagnetization (demagnetization due to exposure to a high temperature environment) is further enhanced.

However, it is well known that the effect of the replacement with the heavy rare elements such as Dy, Tb and the like on improving coercivity at the room temperature is high, but the changes of magnetic anisotropic energy in temperature, which is the main factor of coercivity, is significantly large. Thus, it means that coercivity is sharply reduced at a high temperature environment of the rare earth based magnet. Therefore, the present inventors consider that it is also important to control the microstructure as shown below in order to obtain the rare earth based magnet with high temperature demagnetization inhibited. It is thought that the rare earth based magnet with excellent temperature stability is obtained if the improvement of coercivity can be realized by controlling the microstructure of the sintered magnet.

The coercivity of the rare earth based magnet, i.e., R-T-B based sintered magnet, depends on difficulty of nucleation of reverse magnetic domains. The coercivity becomes small if nucleation of reverse magnetic domains is easy, while the coercivity becomes large if nucleation is difficult. As a method of making nucleation of reverse magnetic domains difficult, it is considered that the main phase crystal grains with high anisotropy constant are isolated by non-magnetic phases. By means that the main phase crystal grains are magnetically isolated with non-magnetic grain boundary phases, magnetic influence from the adjacent main phase crystal grains can be inhibited, and thus high coercivity can be realized. However, it is not clear that what structure of the grain boundary phase is formed can make magnetic isolation between the main phase crystal grains satisfy actual application.

Therefore, the present invention is achieved by recognizing the above-mentioned situation. It is an object of the present invention to provide a rare earth based magnet with inhibition of the high temperature demagnetization rate is improved by controlling the microstructure of the rare earth based magnet, specifically by controlling the microstructure to make the main phase crystal grains disperse in the grain boundary phases.

In order to dramatically improving inhibition of the high temperature demagnetization rate, the present inventors have earnestly made a study on the structure of the main phase crystal grains and the grain boundary phases isolating the magnetic coupling between the adjacent main phase crystal grains in the sintered body of the rare earth based magnet. As a result, the following invention is completed.

That is, the rare earth based magnet according to the present invention is a sintered magnet which comprises $R_2T_{14}B$ crystal grains as main phase and grain boundary phases between the $R_2T_{14}B$ crystal grains. When the microstructure of the sintered body is observed in any cross-section of the rare earth based magnet, the grain boundary phase surrounded by three or more main phase crystal grains is regarded as the grain boundary multi-point, further the grain boundary phase surrounded by three main phase crystal grains is regarded as the grain boundary triple-point, the ratio of the grain boundary triple-point in the grain boundary multi-point is 65% or less. In addition, ratio means the ratio of the number of appearances. By setting the ratio of the grain boundary triple-point as such range, the absolute value of the high temperature demagnetization rate can be inhibited to be 2% or less.

More preferably, the ratio of the grain boundary triple-point in the grain boundary multi-point can be 62% or less. By setting the ratio of the grain boundary triple-point as such range, the absolute value of the high temperature demagnetization rate can be inhibited to be 1% or less.

In the rare earth based magnet according to the present invention, since the structure of the grain boundary multi-point surrounded by multiple main phase crystal grains is formed such that, compared to the rare earth based magnet mainly composed by the grain boundary triple-point and obtained by the conventional technology, the region of the grain boundary phase (area in the cross-section) can be broadly formed. Thus, the magnetic isolation effect between the main phase crystal grains can be improved, and the high temperature demagnetization rate can be inhibited.

In the rare earth based magnet according to the present invention, the grain boundary phase in the sintered body contains the elements R-T-M. By adding the rare earth element R, the iron group element T, and further additive element M forming ternary eutectic point together with the R and T as the constituent element of the main phase crystal grains, the numbers of quadruple-point or more in the grain boundary multi-point formed in the sintered body can be increased, and as a result, the numbers of grain boundary triple-point might be the above ratio or less. The reason is that the reaction of the outer edges of the main phase crystal grains and the grain boundary phases can be promoted by addition of the element M, and the main phase crystal grains with particle size decreased appear in the main phase crystal grains due to the reaction, which caused the grain boundary triple-point become quadruple-point or more. The decrease of the particle size caused by the reaction at the outer edges of the main phase crystal grains can be performed in the firing step, and also can be performed in the heat treatment step. In addition, by adding the element M, the interface between the main phase crystal grains and the grain boundary phases also become smooth, and the occurrence of distortion and the like can be inhibited, and thus nucleation of reverse magnetic domains can be prevented.

As the element M promoting the reaction together with the elements R and T forming the main phase crystal grains, Al, Ga, Si, Ge, Sn, Cu and the like can be used.

According to the present invention, a rare earth based magnet with a low demagnetization rate at a high temperature can be provided, and a rare earth based magnet applicable in the motors and the like used in a high temperature environment can be provided.

DETAILED DESCRIPTION OF EMBODIMENTS

Hereinafter, the preferred embodiments of the present invention are illustrated while making a reference to the drawings. Moreover, the rare earth based magnet according to the present invention is a sintered magnet which comprises $R_2T_{14}B$ main phase crystal grains and grain boundary phases, and R contains one or more rare earth elements, T contains one or more elements of iron group including Fe as an essential element, and B is boron. Furthermore, the sintered magnet in which various well-known additive elements are further added or inevitable impurities are contained are also included.

Figure 1:
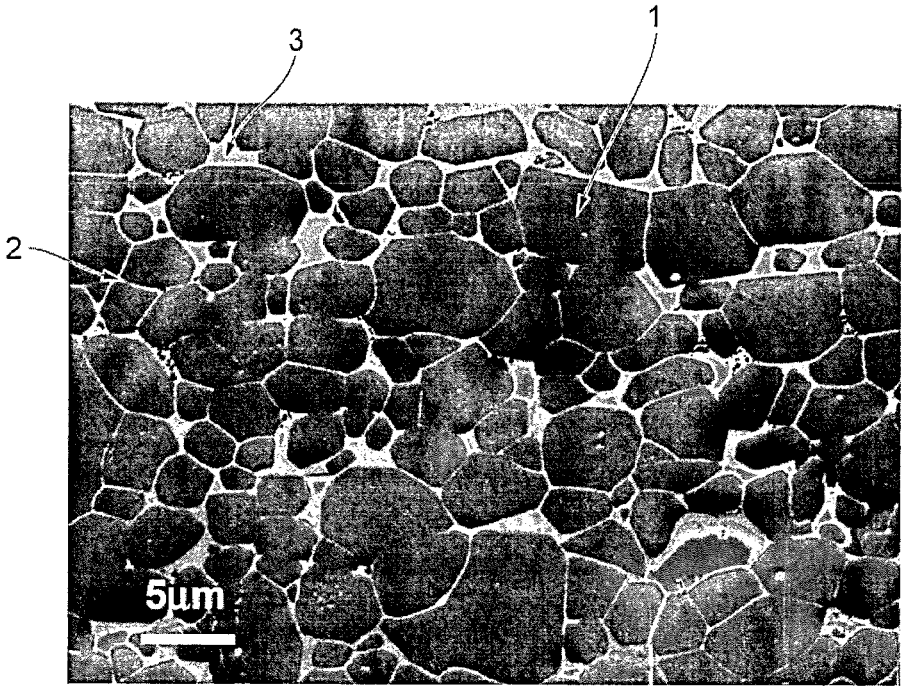
FIG. 1 is an electron microscope photograph showing the grain boundary multi-point of the rare earth based magnet of sample No. 4 in the embodiments according to the present invention.

FIG. 1 is an electron microscope photograph of the cross-sectional structure of the rare earth based magnet in the embodiments according to the present invention. The rare earth based magnet according to the present embodiment comprises $R_2T_{14}B$ main phase crystal grains 1 and grain boundary phases formed between adjacent $R_2T_{14}B$ main phase crystal grains. The grain boundary phase surrounded by three or more main phase crystal grains is called as the grain boundary multi-point. The grain boundary phase 2 shown in FIG. 1 is surrounded by three main phase crystal grains, and it is called as the grain boundary triple-point. On the other hand, for example, the grain boundary phase 3 in FIG. 1 is surrounded by five main phase crystal grains, and it is called as the grain boundary quintuple-point. The rare earth based magnet according to the present invention is characterized in that when the grain boundary phases surrounded by these three or more main phase crystal grains are called as grain boundary multi-point, in any cross-section, the ratio of the grain boundary triple-point in the grain boundary multi-point is 65% or less.

In the present specification, the total number of the multi-point used to evaluate the ratio of the grain boundary multi-point can be 120 or more. By using thus several grain boundary multi-point as the evaluation object, the average distribution in the relatively wide region can be controlled. Hence, when the cross-section of the sintered body of the rare earth based magnet is observed by an electron microscope, magnification is set so that 120 or more grain boundary multi-points may be observed. Further, the difference between two-grain boundary phase and the grain boundary multi-point in the present specification will be described in detail based on the drawings later.

In the $R_2T_{14}B$ main phase crystal grains forming the rare earth based magnet according to the present embodiment, the light rare earth element, the heavy rare earth element or their combination can be used as the rare earth element R. From the viewpoint of materials cost, R is preferably Nd, Pr or the combination thereof. The other elements are described above. The preferable range of the combination of Nd and Pr is described below.

The rare earth based magnet according to the present embodiment can contain trace amount of additive elements. The well-known elements can be used as the additive element. The additive elements are preferably those having eutectic composition with the element R as the constituent element of the $R_2T_{14}B$ main phase crystal grains. From this point, Cu and the like is preferable as the additive element and other element also can be used as the additive element. The preferable addition range of Cu is described below.

The rare earth based magnet according to the present embodiment can further contain Al, Ga, Si, Ge, Sn and the like as the element M promoting the reaction of the main phase crystal grain in the powder metallurgic process. The preferable addition amount of the element M is described below. By adding the element M besides Cu into the rare earth based magnet, the surface layer of the main phase crystal grains can be reacted and thus distortion, defects and the like can be removed, simultaneously, the grain boundary triple-point in the grain boundary phase turns into the quadruple-point or more and thus the ratio of the grain boundary triple-point in the gain boundary multi-point is reduced, therefore the region of the grain boundary phase in the sintered body is enlarged.

In the rare earth based magnet according to the present embodiment, the content of the above elements relative to the total mass is shown as follows.

R: 29.5~33 mass %,
B: 0.7~0.95 mass %,
M: 0.03~1.5 mass %,
Cu: 0.01~1.5 mass %, and
Fe: the balance substantially, and
The total content of the elements except Fe in the elements accounting for the balance:
5 mass % or less.

R contained in the rare earth based magnet according to the present embodiment is further described in detail. Any one of Nd and Pr must be contained as R. The ratio of Nd and Pr in R can be 80~100 atomic % based on the total amount of Nd and Pr, and also can be 95~100 atomic %. The good residual flux density and coercivity can be achieved if it is at such range. Moreover, in the rare earth based magnet according to the present embodiment, the heavy rare earth elements such as Dy, Tb and the like can be contained as R. In this circumstance, the content of heavy rare earth elements in the total mass of the rare earth based magnet is 1.0 mass % or less based on the total heavy rare earth elements, preferably 0.5 mass % or less, more preferably 0.1 mass % or less. In the rare earth based magnet according to the present embodiment, even if the content of the heavy rare earth elements is reduced like this, the good high coercivity also can be obtained and the high temperature demagnetization rate is inhibited by making the content of other elements and atom ratio satisfy specific conditions.

The content of B is 0.7~0.95 mass % in the rare earth based magnet according to the present embodiment. The content of B is made into such specific range which is less than the stoichiometric ratio of basic composition represented with $R_2T_{14}B$, and thus combined with the additive elements, the reaction at the surface of the main phase crystal grains in the powder metallurgic process easily occurs.

The rare earth based magnet according to the present embodiment further contains trace amount of the additive elements. The well-known elements can be used as the additive element. The additive elements preferably have eutectic point with the element R as the constituent element of $R_2T_{14}B$ main phase crystal grains in the phase diagram. From this point, Cu and the like is preferably as the additive element. Other elements also can be regarded as the additive element. As the additive amount of the element Cu, it is 0.01~1.5 mass % based on the whole. By making the additive amount within such range, the element Cu is only unevenly distributed in the grain boundary phase. On the other hand, as for the element T as the constituent element of the main phase crystal grains and the element Cu, it is thought that the combination is hard to form eutectic point since that Fe and Cu become monotectic type in the phase diagram. Here, the element M is added such that R-T-M ternary system forms eutectic point. As such the element M, for example, Al, Ga, Si, Ge, Sn and the like can be exemplified. As the content of the element M, it is 0.03~1.5 mass %. By containing the element M in such range, the reaction at the surface of the main phase crystal grains in the powder metallurgic process can be promoted, and the decrease of the particle size of the main phase crystal grains can be enhanced. Thus, the ratio of grain boundary multi-point such as grain boundary quadruple-point or more can be increased.

In the rare earth based magnet according to the present embodiment, as the element represented by T in the basic composition $R_2T_{14}B$, in addition to containing Fe as essential, other iron group elements can be further contained. As the other iron group elements, Co is preferable. In this case, the content of Co is preferably more than 0 mass % and 3.0 mass % or less. By containing Co within such range in the rare earth based magnet, corrosion resistance can be improved besides Curie temperature is enhanced (become higher). The content of Co can be 0.3~2.5 mass %.

The rare earth based magnet according to the present embodiment can contain C as the other element. The content of C is 0.05~0.3 mass %. If the content of C is less than the range, coercivity becomes insufficient. If the content is larger than the range, the ratio of the value of the magnetic field (Hk) when the magnetization is 90% of residual flux density, relative to coercivity, i.e., so-called square ratio (Hk/coercivity) becomes insufficient. In order to obtain better coercivity and square ratio, the content of C also can be 0.1~0.25 mass %.

The rare earth based magnet according to the present embodiment also can contain 0 as the other element. The content of 0 is 0.03~0.4 mass %. If the content of 0 is less than the range, the corrosion resistance of the sintered magnet is insufficient. If the content is over the range, the liquid phase cannot be sufficiently formed in the sintered magnet, and thus coercivity reduces. In order to obtain better corrosion resistance and coercivity, the content of 0 can be 0.05~0.3 mass %, and also can be 0.05~0.25 mass %.

In addition, in the rare earth based magnet according to the present embodiment, the content of N is preferably 0.15 mass % or less. If the content of N is more than the range, coercivity trends to be insufficient.

In addition, the content of each element falls within the above range in the sintered magnet according to the present embodiment. And, when the number of atoms of C, O and N are denoted as [C], [O], and [N] respectively, the relationship of $[O]/([C]+[N])<0.60$ is preferably satisfied. With such a composition, the absolute value of the high temperature demagnetization rate can be inhibited to be small.

Further, the number of atoms of the elements Nd, Pr, B, C and M in the sintered magnet of the present embodiment preferably satisfy the following relation. That is, when the number of atoms of the elements Nd, Pr, B, C and M are denoted as [Nd], [Pr], [B], [C] and [M] respectively, the relationship of $0.27<[B]/([Nd]+[Pr])<0.43$ and $0.07<([M]+[C])/[B]<0.60$ is preferably satisfied. With such a composition, high coercivity can be obtained.

Hereinafter, an example of the method for producing the rare earth based magnet according to the present embodiment is described. The rare earth based magnet according to the present embodiment may be produced by a usual powder metallurgic method comprising a preparation step of producing the raw alloys, a pulverization step of pulverizing the raw alloys to obtain raw fine powders, a molding step of molding the raw fine powders to obtain a molded body, a sintering step of firing the molded body to obtain a sintered body, and a heat treating step of subjecting the sintered body to an aging treatment.

The preparation step is the step for producing the raw alloys having the elements contained in the rare earth based magnet according to the present embodiment. Firstly, the raw metals having the specified elements are prepared, and subjected to a strip casting method and the like. The raw alloys are thus produced. As the raw metals, for examples, rare earth based metals or rare earth based alloys, pure iron, pure cobalt, ferroboron or alloys thereof are exemplified. These raw metals are used to produce the raw alloys of the rare earth based magnet having the desired composition.

The pulverization step is the step for pulverizing the raw alloys obtained in the preparation step into raw fine powders. This step is preferably performed in two stages comprising a coarse pulverization step and a fine pulverization step, and may also be performed as one stage. The coarse pulverization may be performed by using, for example, a stamp mill, a jaw crusher, a braun mill and the like under an inert gas atmosphere. A hydrogen adsorption pulverization in which pulverization is performed after adsorbing hydrogen may also be performed. In the coarse pulverization step, the raw alloys are pulverized until the particle size is around several hundred micrometers to several millimeters.

The fine pulverization step is the step in which the coarse powders obtained in the coarse pulverization step is finely pulverized to prepare the raw fine powders with the average particle size of several micrometers. The average particle size of the raw fine powders may be set under the consideration of the growth of the crystal grains after sintering. For example, the fine pulverization may be performed by a jet mill.

The molding step is a step for molding the raw fine powders in the magnetic field to produce a molded body. Specifically, after the raw fine powders are filled into a mold equipped in an electromagnet, the molding is performed by orientating the crystallographic axis of the raw fine powders by applying a magnetic field via the electromagnet, while pressurizing the raw fine powders. The molding may be performed in a magnetic field of 1000~1600 kA/m under a pressure of about 30~300 MPa.

The sintering step is a step for firing the molded body to obtain a sintered body. After being molded in the magnetic field, the molded body may be fired in a vacuum or an inert gas atmosphere to obtain a sintered body. Preferably, the firing conditions are suitably set depending on the factors such as composition of the molded body, the pulverization method of the raw fine powders, grain size and the like. For example, the sintering may be performed at 1000° C.~1100° C. for 1~10 hours.

The heat treating step is a step for subjecting the sintered body to an aging treatment. After this step, the composition ratios of various grain boundary multi-point formed between adjacent $R_2T_{14}B$ main phase crystal grains are determined. However, these microstructures are not only controlled in this step, but are determined in view of the conditions of the above sintering step and the situation of the raw fine powders. Hence, the relationship between the conditions of the heat treatment and the microstructure of the sintered body may be considered to set the temperature and time period of the heat treatment. The heat treatment may be performed at a temperature ranging from 500° C. to 900° C., and may also be performed in two stages comprising a heat treatment at 800° C. nearby followed by a heat treatment at 550° C. nearby. The cooling rate during the cooling process of the heat treatment may also alter the microstructure. The cooling rate is preferably 100° C./min or more, particularly preferably 300° C./min or more. By the above aging treatment of the present invention in which the cooling rate is faster than usual, the segregation of the ferromagnetic phase in the grain boundary phase can be effectively inhibited. Thus, the causes for reducing coercivity and further deteriorating the high temperature demagnetization rate can be eliminated. By respectively setting the composition of the raw alloys, the above sintering conditions and the conditions of heat treatment, the composition ratios of various grain boundary multi-point in the cross-section of the sintered body can be respectively controlled. In the present embodiment, the method for controlling the composition ratios of the various grain boundary multi-point by the conditions of heat treatment is exemplified. The rare earth based magnet of the present invention obtained by the method is not limited. By adopting the control of the composition factors and the sintering conditions, the rare earth based magnet with the same effect even under the different conditions from the heat treatment exemplified in the present embodiment can be obtained.

The rare earth based magnet according to the present embodiment can be obtained by the above method. But the production method of the rare earth based magnet is not limited thereto and can be appropriately changed.

Next, the evaluation for the high temperature demagnetization rate of the rare earth based magnet according to the present embodiment is described. The shape of the sample used for evaluation is not particularly limited, and for example, it is a shape, that is generally used, with a Permeance Coefficient of 2. Firstly, residual flux of the sample at room temperature (25° C.) is measured and regarded as B0. The residual flux may be measured by for example a magnetic flux meter. Next, the sample is exposed to a high temperature of 140° C. for 2 hours, and then returns to the room temperature. Once the temperature of the sample returns to the room temperature, the residual flux is measured again and regarded as B1. Thus, the high temperature demagnetization rate D is evaluated by the following formula.

$$D=(B1-B0)/B0\times 100(\%)$$

The microstructure of the rare earth based magnet according to the present embodiment, i.e., the ratio of the grain boundary triple-point in the grain boundary multi-point can be evaluated by using an electron microscope. The magnification can be properly set to observe 120 or more grain boundary multi-point in the target cross-section as described above. The observation of the grinded cross-section of the sample after evaluating the high temperature demagnetization rate is conducted. The grinded cross-section may be parallel to the orientation axis, may perpendicular to the orientation axis, or may be any angle with the orientation axis.

Next, the present invention is further described in detail with reference to the specific examples, but the present invention is not limited thereto.

EXAMPLES

Firstly, the raw metals of the sintered magnet were prepared. The raw alloys were respectively produced to obtain the compositions of the sintered magnets of samples No. 1~19 shown in the following Table 1 and Comparative Examples 1~2 by using these raw metals through a strip casting method. In addition, as for the content of each element shown in Table 1 and Table 2, the contents of T, R, Cu and M were measured by fluorescent X-ray analysis, and the content of B was measured by inductively-coupled plasma spectrometry. Further, the content of O was measured by an inert gas fusion-nondispersive infrared absorption method, the content of C was measured by combustion in oxygen flow-infrared absorption method, and the content of N was measured by an inert gas fusion-thermal conductivity method. In addition, [O]/([C]+[N]), [B]/([Nd]+[Pr]) and ([M]+[C])/[B] could be calculated by obtaining the number of atoms of these element from their contents obtained by these methods.

Next, after adsorption of hydrogen onto the resultant raw alloys, hydrogen pulverization by desorbing hydrogen was performed in Ar atmosphere at 600° C. for 1 hour. Then, the resultant pulverized materials were cooled to room temperature in Ar atmosphere.

After adding oleic amide as a grinding aid to the resultant pulverized materials and mixing therewith, a fine pulverization was performed by using a jet mill to obtain raw powders with an average particle size of 3~4 μm.

The resultant raw powders were molded in a low-oxygen atmosphere under the condition of an alignment magnetic field of 1200 kA/m and a molding pressure of 120 MPa to obtain a molded body.

Then, the molded body was fired in a vacuum at 1030~1050° C. for 4 hours, and quenched to obtain a sintered body. The obtained sintered body was subject to the two-stage heat treatment at 900° C. and at 500° C. The heat treatment of the first stage at 900° C. (the aging 1) was performed for an hour and the cooling rate was 100° C./min. The time period of the heat treatment and the cooling rate of the cooling process was changed in the heat treatment of the second stage at 500° C. (the aging 2) to prepare several samples with different ratio of the grain boundary triple-point in the grain boundary multi-point.

The residual flux density and the coercivity of the obtained samples were respectively measured by a B—H tracer. Next, the high temperature demagnetization rate was measured. These results were shown in Table 1. Subsequently, with respect to the cross-section of the samples No. and the samples of the comparative examples, whose magnetic properties had been measured, were observed through an electron microscope, and the ratio of the grain boundary triple-point in the grain boundary multi-point was evaluated. The evaluating results of the corresponding samples No. and the comparative examples were shown in the column 'ratio of grain boundary triple-point' of Table 1.

In addition, the cooling rate of heat treatment at the second stage (the aging 2) was shown in Table 2. Further, the values of [O]/([C]+[N]), [B]/([Nd]+[Pr]) and ([M]+[C])/[B] in each sample was calculated when the number of atoms of the elements C, O, N, Nd, Pr, B and M contained in the sintered body were respectively regarded as [C], [O], [N], [Nd], [Pr], [B] and [M], and the values were shown in Table 2. The amount of oxygen and the amount of nitrogen contained in the rare earth based magnet were adjusted to the ranges shown in Table 2 by controlling the atmospheres from the pulverization step to the heat treating step, especially adjusting the amount of oxygen and the amount of nitrogen contained in the atmosphere of the pulverization step. Moreover, the amount of carbon contained in the raw materials of the rare earth based magnet was adjusted to the range shown in Table 2 by adjusting the amount of the grinding aid added in the pulverization step.

TABLE 1

| | Composition of sintered magnet (mass %) | | | | | | | | | | | | Firing | | Aging 1 | | Aging 2 | | Magnetic properties | | | |
|---|---|---|---|---|---|---|---|---|---|---|---|---|---|---|---|---|---|---|---|---|---|---|
| | R | | | | | M | | | | | | | | Time | | Time | | Time | | | High temperature | Ratio of grain |
| Sample No. | Total | Nd | Pr | Dy | B | Cu | Al | Ga | Si | Ge | Sn | Fe | Temperature ° C. | period hr | Temperature ° C. | period hr | Temperature ° C. | period hr | Br kG | Hcj kOe | demagnetization rate % | boundary triple-point % |
| Sample No. 1 | 33.0 | 33.0 | 0.0 | 0.0 | 0.70 | 0.7 | 0.2 | 1.3 | 0.0 | 0.0 | 0.0 | bal. | 1030 | 4 | 900 | 1 | 500 | 20 | 13.3 | 26.0 | −0.2 | 52.2 |
| Sample No. 2 | 33.0 | 33.0 | 0.0 | 0.0 | 0.70 | 0.7 | 0.2 | 1.3 | 0.0 | 0.0 | 0.0 | bal. | 1030 | 4 | 900 | 1 | 500 | 1 | 13.3 | 25.0 | −0.2 | 58.3 |
| Sample No. 3 | 32.5 | 32.5 | 0.0 | 0.0 | 0.80 | 0.4 | 0.2 | 0.7 | 0.0 | 0.0 | 0.0 | bal. | 1030 | 4 | 900 | 1 | 500 | 20 | 13.5 | 24.0 | −0.3 | 55.1 |
| Sample No. 4 | 32.5 | 32.5 | 0.0 | 0.0 | 0.80 | 0.4 | 0.2 | 0.7 | 0.0 | 0.0 | 0.0 | bal. | 1030 | 4 | 900 | 1 | 500 | 1 | 13.5 | 23.0 | −0.3 | 59.7 |
| Sample No. 5 | 32.0 | 32.0 | 0.0 | 0.0 | 0.83 | 0.1 | 0.2 | 0.5 | 0.0 | 0.0 | 0.0 | bal. | 1030 | 4 | 900 | 1 | 500 | 20 | 13.7 | 23.0 | −0.3 | 57.4 |
| Sample No. 6 | 32.0 | 32.0 | 0.0 | 0.0 | 0.83 | 0.1 | 0.2 | 0.5 | 0.0 | 0.0 | 0.0 | bal. | 1030 | 4 | 900 | 1 | 500 | 10 | 13.7 | 22.5 | −0.4 | 61.6 |
| Sample No. 7 | 32.0 | 32.0 | 0.0 | 0.0 | 0.83 | 0.1 | 0.2 | 0.5 | 0.0 | 0.0 | 0.0 | bal. | 1030 | 4 | 900 | 1 | 500 | 5 | 13.7 | 22.0 | −0.4 | 61.0 |
| Sample No. 8 | 32.0 | 32.0 | 0.0 | 0.0 | 0.83 | 0.1 | 0.2 | 0.5 | 0.0 | 0.0 | 0.0 | bal. | 1030 | 4 | 900 | 1 | 500 | 1 | 13.7 | 21.7 | −0.3 | 60.7 |
| Sample No. 9 | 32.0 | 32.0 | 0.0 | 0.0 | 0.83 | 0.1 | 0.2 | 0.0 | 0.3 | 0.0 | 0.0 | bal. | 1030 | 4 | 900 | 1 | 500 | 1 | 13.7 | 19.5 | −0.9 | 61.8 |
| Sample No. 10 | 32.0 | 32.0 | 0.0 | 0.0 | 0.83 | 0.1 | 0.2 | 0.0 | 0.0 | 0.3 | 0.0 | bal. | 1030 | 4 | 900 | 1 | 500 | 1 | 13.7 | 19.2 | −1.0 | 62.0 |
| Sample No. 11 | 32.0 | 32.0 | 0.0 | 0.0 | 0.83 | 0.1 | 0.2 | 0.0 | 0.0 | 0.0 | 0.3 | bal. | 1030 | 4 | 900 | 1 | 500 | 1 | 13.7 | 19.4 | −0.8 | 61.7 |
| Sample No. 12 | 32.0 | 32.0 | 0.0 | 0.0 | 0.83 | 0.1 | 0.5 | 0.0 | 0.0 | 0.0 | 0.0 | bal. | 1030 | 4 | 900 | 1 | 500 | 1 | 13.6 | 19.8 | −0.7 | 62.6 |
| Sample No. 13 | 31.5 | 31.5 | 0.0 | 0.0 | 0.87 | 0.1 | 0.2 | 0.3 | 0.0 | 0.0 | 0.0 | bal. | 1030 | 4 | 900 | 1 | 500 | 1 | 13.8 | 20.0 | −0.7 | 61.5 |
| Sample No. 14 | 31.5 | 31.5 | 0.0 | 0.0 | 0.92 | 0.1 | 0.2 | 0.2 | 0.0 | 0.0 | 0.0 | bal. | 1030 | 4 | 900 | 1 | 500 | 1 | 13.9 | 19.0 | −1.2 | 62.5 |
| Sample No. 15 | 31.0 | 31.0 | 0.0 | 0.0 | 0.95 | 0.1 | 0.2 | 0.2 | 0.0 | 0.0 | 0.0 | bal. | 1050 | 4 | 900 | 1 | 500 | 1 | 14.0 | 18.0 | −1.5 | 64.6 |
| Sample No. 16 | 30.5 | 30.5 | 0.0 | 0.0 | 0.95 | 0.1 | 0.2 | 0.0 | 0.0 | 0.0 | 0.0 | bal. | 1050 | 4 | 900 | 1 | 500 | 1 | 14.1 | 17.0 | −1.8 | 65.0 |
| Sample No. 17 | 32.0 | 25.0 | 7.0 | 0.0 | 0.83 | 0.1 | 0.2 | 0.5 | 0.0 | 0.0 | 0.0 | bal. | 1030 | 4 | 900 | 1 | 500 | 1 | 13.7 | 21.7 | −0.3 | 61.7 |
| Sample No. 18 | 32.0 | 31.0 | 0.0 | 1.0 | 0.83 | 0.1 | 0.2 | 0.5 | 0.0 | 0.0 | 0.0 | bal. | 1030 | 4 | 900 | 1 | 500 | 1 | 13.5 | 24.0 | −0.3 | 64.5 |
| Sample No. 19 | 33.0 | 33.0 | 0.0 | 0.0 | 0.70 | 0.7 | 0.2 | 1.3 | 0.0 | 0.0 | 0.0 | bal. | 1030 | 4 | 900 | 1 | 500 | 72 | 12.6 | 15.9 | −0.1 | 44.8 |
| Comparative Example 1 | 30.0 | 30.0 | 0.0 | 0.0 | 1.00 | 0.5 | 0.2 | 0.0 | 0.0 | 0.0 | 0.0 | bal. | 1050 | 4 | 900 | 1 | 500 | 1 | 14.2 | 15.0 | −8.0 | 72.5 |
| Comparative Example 2 | 30.5 | 22.0 | 6.5 | 2.0 | 1.00 | 0.5 | 0.2 | 0.0 | 0.0 | 0.0 | 0.0 | bal. | 1050 | 4 | 900 | 1 | 500 | 1 | 13.8 | 16.0 | −4.0 | 69.3 |

TABLE 2

| Sample No. | Contents of N, C and O contained in sintered magnet N mass % | C mass % | O mass % | Cooling rate of aging 2 ° C./min | Ratio of number of atoms [B]/([Nd] + [Pr]) | ([M] + [C]/[B]) | [O]/([C] + [N]) |
|---|---|---|---|---|---|---|---|
| Sample No. 1 | 0.05 | 0.15 | 0.10 | 600 | 0.28 | 0.59 | 0.39 |
| Sample No. 2 | 0.05 | 0.15 | 0.09 | 600 | 0.28 | 0.59 | 0.35 |
| Sample No. 3 | 0.04 | 0.14 | 0.09 | 300 | 0.33 | 0.39 | 0.39 |
| Sample No. 4 | 0.04 | 0.13 | 0.08 | 300 | 0.33 | 0.38 | 0.37 |
| Sample No. 5 | 0.04 | 0.14 | 0.09 | 600 | 0.35 | 0.34 | 0.39 |
| Sample No. 6 | 0.05 | 0.13 | 0.08 | 600 | 0.35 | 0.33 | 0.35 |
| Sample No. 7 | 0.04 | 0.13 | 0.07 | 600 | 0.35 | 0.33 | 0.32 |
| Sample No. 8 | 0.04 | 0.14 | 0.06 | 600 | 0.35 | 0.34 | 0.26 |
| Sample No. 9 | 0.04 | 0.10 | 0.09 | 100 | 0.35 | 0.34 | 0.51 |
| Sample No. 10 | 0.06 | 0.10 | 0.09 | 100 | 0.35 | 0.26 | 0.45 |
| Sample No. 11 | 0.05 | 0.11 | 0.09 | 100 | 0.35 | 0.25 | 0.44 |
| Sample No. 12 | 0.04 | 0.12 | 0.09 | 100 | 0.35 | 0.37 | 0.44 |
| Sample No. 13 | 0.04 | 0.10 | 0.08 | 300 | 0.37 | 0.25 | 0.45 |
| Sample No. 14 | 0.04 | 0.09 | 0.09 | 550 | 0.39 | 0.21 | 0.55 |
| Sample No. 15 | 0.05 | 0.09 | 0.09 | 300 | 0.41 | 0.20 | 0.51 |
| Sample No. 16 | 0.04 | 0.10 | 0.10 | 400 | 0.42 | 0.18 | 0.56 |
| Sample No. 17 | 0.04 | 0.09 | 0.06 | 600 | 0.34 | 0.29 | 0.36 |
| Sample No. 18 | 0.04 | 0.09 | 0.06 | 600 | 0.36 | 0.29 | 0.36 |
| Sample No. 19 | 0.04 | 0.12 | 0.10 | 500 | 0.28 | 0.56 | 0.49 |
| Comparative Example 1 | 0.04 | 0.09 | 0.12 | 40 | 0.44 | 0.16 | 0.73 |
| Comparative Example 2 | 0.04 | 0.10 | 0.11 | 60 | 0.47 | 0.17 | 0.62 |

It could be seen from Table 1 that the high temperature demagnetization rate was inhibited to be −2% or less even when the rare earth based magnet of samples No. 1~19 was adopted under high temperature. In Comparative Examples 1 and 2, the high temperature demagnetization rate was −4% or more, and thus the effect of inhibiting the high temperature demagnetization was not brought out. The effect of inhibiting the high temperature demagnetization in the samples No. 1~19 was realized by setting the ratio of the grain boundary triple-point in the total grain boundary multi-point in any cross-section of the sintered magnet to be 65% or less. Further, it could be known from Table 1 that if the ratio of the grain boundary triple-point in the grain boundary multi-point was 62% or less, the high temperature demagnetization rate was −1% or less, and thus it was more preferable. In addition, it was shown from Sample No. 18 that inhibition of high temperature demagnetization rate could be sharply increased by synergistic effect of the ratio of the grain boundary triple-point in the grain boundary multi-point and the addition of heavy rare earth element Dy.

Figure 3B:
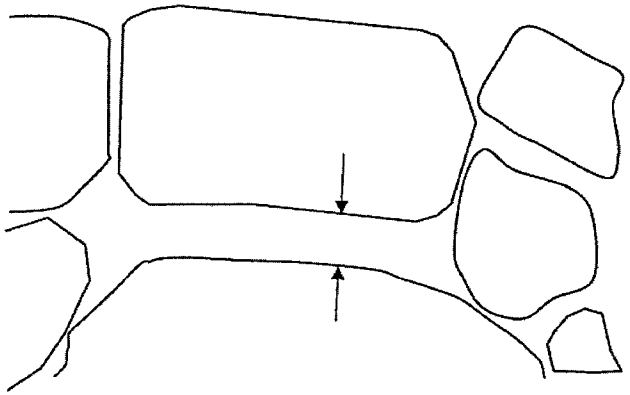
FIGS. 3*a* and 3*b* are a schematic diagram illustrating determination method of the grain boundary multi-point in the present embodiment.
Figure 3A:
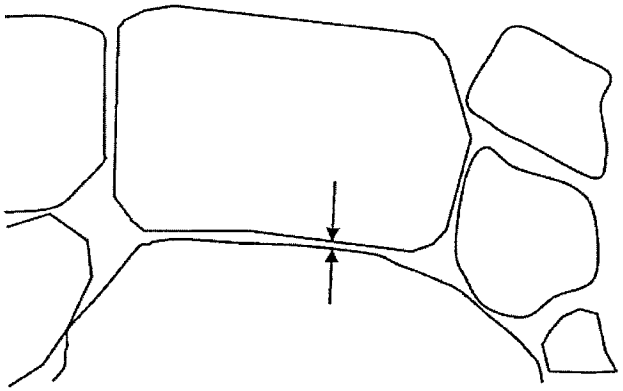

Here, determination method of the grain boundary multi-point in the present specification was described based on FIGS. 3*a* and 3*b*. FIG. 3 (*a*) was a pattern drawing showing the case that the width (indicated by an arrow in the figure) of the grain boundary phase between two main phase crystal grains was narrow. FIG. 3 (*b*) was a pattern drawing showing the case that the width of the grain boundary phase between two main phase crystal grains was broad. This part was called as two-grain boundary phase before, which was different from the grain boundary multi-point. However, in the present specification, as shown in FIG. 3 (*b*), when the narrowest width of the grain boundary phase was 200 nm or more, the grain boundary phase was regarded as the composition part of the grain boundary multi-point instead of the two-grain boundary phase. Hence, the grain boundary phase focused in FIG. 3 (*b*) became the grain boundary quintuple-point surrounded by five main phase crystal grains. Moreover, although sometimes micro deposits were confirmed in the grain boundary phase, they were neglected in the evaluation of the grain boundary multi-point.

Based on FIG. 1, the specific evaluating results were listed here. FIG. 1 was an electron microscope photograph when observing the cross-section of Sample No. 4. The obtained numbers of various multi-point in FIG. 1 were shown in Table 3. In addition, when calculating the grain boundary multi-point, human-induced bias was eliminated while calculating all visual grain boundary multi-point.

TABLE 3

| Species of grain boundary multi-point | Number | Ratio (%) |
|---|---|---|
| Triple-point | 100 | 60.2% |
| Quadruple-point | 41 | 24.7% |
| Quintuple-point | 12 | 7.2% |
| Sextuple-point | 10 | 6.0% |
| Septuple-point | 2 | 1.2% |
| Octuple-point | 1 | 0.6% |
| Nonuple-point | 0 | 0.0% |
| Decuple-point | 0 | 0.0% |
| Undecuple-point | 0 | 0.0% |
| Total | 166 | |

In Table 3, the total number of the grain boundary multi-point in the evaluated cross-section was 166, among which 100 were the grain boundary triple-points. Therefore, the ratio of the grain boundary triple-point was 60.2%. It means that the ratio of the grain boundary multi-point (quadruple-point or more) except grain boundary triple-point was high. As a result, it was shown that the adjacent main phase crystal grains were sufficiently separated by the grain boundary phase.

Figure 2:
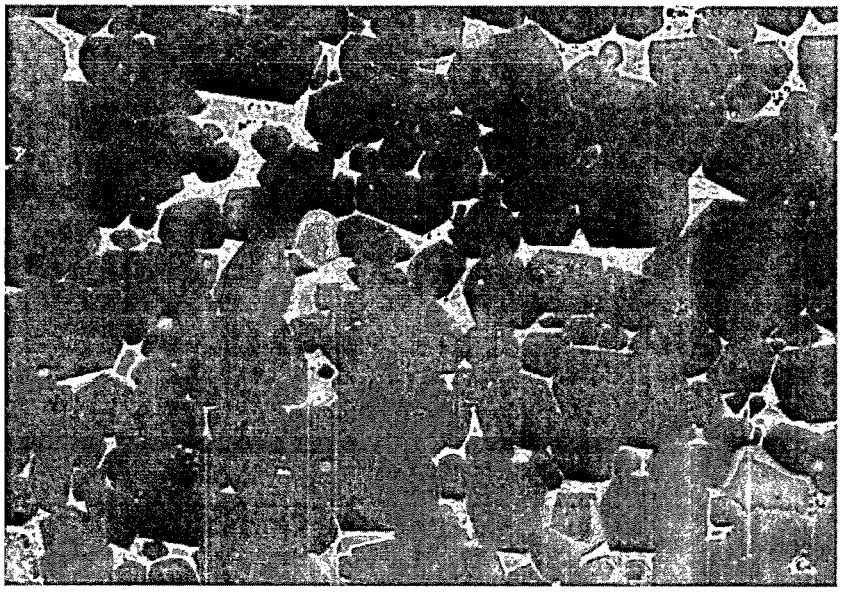
FIG. 2 is an electron microscope photograph showing the grain boundary multi-point of the rare earth based magnet in Comparative Example 2 of the present embodiment.

On the other hand, the electron microscope photograph of the cross-section in the sintered body of the rare earth based magnet in Comparative Example 2 was shown in FIG. 2. Based on the electron microscope photograph, the same evaluation of the grain boundary multi-point was conducted and its results were shown in Table 4.

TABLE 4

| Species of grain boundary multi-point | Number | Ratio (%) |
|---|---|---|
| Triple-point | 104 | 69.3% |
| Quadruple-point | 26 | 17.3% |
| Quintuple-point | 10 | 6.7% |
| Sextuple-point | 4 | 2.7% |
| Septuple-point | 3 | 2.0% |
| Octuple-point | 2 | 1.3% |
| Nonuple-point | 0 | 0.0% |
| Decuple-point | 0 | 0.0% |
| Undecuple-point | 0 | 0.0% |
| Dodecuple-point | 0 | 0.0% |
| Tredecuple-point | 0 | 0.0% |
| Tetradecuple-point | 1 | 0.7% |
| Total | 150 | |

In Table 4, the total number of the grain boundary multi-point in the evaluated cross-section was 150, among which 104 were the grain boundary triple-points. Thus, the ratio of the grain boundary triple-point was 69.3%. It means that there were a lot of the grain boundary triple-points in the grain boundary multi-point. It also could be known from FIG. 1 and FIG. 2 that since the grain boundary triple-point was the grain boundary multi-point formed by densely packing adjacent main phase crystal grains, if the ratio of the grain boundary triple-point increased, separation of the adjacent main phase crystal grains caused by the grain boundary phase was insufficient, which caused that the effect of inhibiting the high temperature demagnetization rate would not be realized.

In addition, as shown in Table 2, in the Samples No. 1~19 that met the conditions of the present invention, the microstructure was formed in the sintered magnet and the number of atoms of the elements Nd, Pr, B, C and M contained in the sintered magnet satisfied the specific relation as follows. That is, when the number of atoms of the elements Nd, Pr, B, C and M were denoted as [Nd], [Pr], [B], [C] and [M] respectively, the relations of $0.27<[B]/([Nd]+[Pr])<0.43$ and $0.07<([M]+[C])/[B]<0.60$ were satisfied. Thus, when $0.27<[B]/([Nd]+[Pr])<0.43$ and $0.07<([M]+[C])/[B]<0.60$, the coercivity (Hcj) could be effectively improved.

Moreover, as shown in Table 2, in the Samples No. 1~19 that met the conditions of the present invention, the microstructure was formed in the sintered magnet and the number of atoms of O, C and N contained in the sintered magnet satisfied the specific relation as follows. That is, when the number of atoms of O, C and N were denoted as [O], [C], and [N] respectively, the relation of $[O]/([C]+[N])<0.60$ was satisfied. Thus, when $[O]/([C]+[N])<0.60$, the high temperature demagnetization rate D can be effectively inhibited.

The present invention was described with reference to the embodiments above. The embodiments were exemplified, and various modification and changes may be included within the claims of the present invention. In addition, one skilled in the art will understand that the modified examples and changes are within the claims of the present invention. Thus, the description and the drawings in the present specification should be considered as illustrative but not limited.

According to the present invention, a rare earth based magnet that is applicable even at a high temperature environment may be provided.

DESCRIPTION OF REFERENCE NUMERALS

1 Main phase crystal grains
2, 3 Grain boundary phase

What is claimed is:

1. A rare earth based magnet, the rare earth based magnet being a sintered magnet that comprises $R_2T_{14}B$ crystal grains as the main phase and grain boundary phases between the $R_2T_{14}B$ crystal grains, R represents one or more rare earth elements, T represents one or more elements of iron group including Fe as an essential element, and B is boron, the rare earth based magnet contains at least one element M, wherein the at least one element M is Ga and optionally at least one selected from the group consisting of Al, Si, Ge and Sn, the rare earth based magnet contains Cu, the content of the above elements relative to the total mass is shown as follows;

R: 29.5-33 mass %,
B: 0.7-0.95 mass %,
M: 0.5-1.5 mass %,
Ga: 0.5-1.3 mass %,
Cu: 0.01-1.5 mass %, and
Fe: the balance, and the total content of the elements except R, T, B, M, Cu and Fe: 5 mass % or less, the content of heavy rare earth elements in the total mass of the rare earth based magnet is 0.5 mass % or less, and wherein in any cross-section of the rare earth based magnet having a sampling area containing 120 or more grain boundary multi-points, a ratio of a number of grain boundary triple-points to a number of grain boundary multi-points is 61.7% or less, where the grain boundary multi-point is defined as a grain boundary phase surrounded by three or more main phase crystal grains, and the grain boundary triple-point is defined as a grain boundary phase surrounded by three main phase crystal grains, the absolute value of the high temperature demagnetization rate D is 0.4% or less, in which $$D=100\times(B1-B0)/B0(\%),$$

B0: residual flux at room temperature (25° C.), and

B1: residual flux brought back to room temperature after being exposed to a temperature of 140° C. for 2 hours, and the coercivity is 21.7 kOe or more.

2. The rare earth based magnet according to claim 1, wherein, said grain boundary phase contains at least one or more elements selected from the group consisting of Al, Ga, Si, Ge, Sn and Cu.

* * * * *